US010507943B2

(12) United States Patent
Izquierdo Ereño et al.

(10) Patent No.: US 10,507,943 B2
(45) Date of Patent: Dec. 17, 2019

(54) METHOD FOR VACUUM PACKAGING OF PRODUCTS

(71) Applicant: Ulma Packaging Technological Center, S. Coop., Oñati (ES)

(72) Inventors: Eneko Izquierdo Ereño, Oñati (ES); Aitor Olalde Tome, Oñati (ES); Iosu Ugarte Barrena, Oñati (ES)

(73) Assignee: ULMA PACKAGING TECHNOLOGICAL CENTER, S. COOP., Oñati, Gipuzkoa (ES)

( * ) Notice: Subject to any disclaimer, the term of this patent is extended or adjusted under 35 U.S.C. 154(b) by 244 days.

(21) Appl. No.: 15/863,068

(22) Filed: Jan. 5, 2018

(65) Prior Publication Data

US 2018/0127128 A1 May 10, 2018

Related U.S. Application Data

(63) Continuation of application No. PCT/EP2016/065017, filed on Jun. 28, 2016.

(30) Foreign Application Priority Data

Jul. 7, 2015 (EP) ..... 15382359

(51) Int. Cl.
*B65B 31/02* (2006.01)
*B65B 61/06* (2006.01)
(Continued)

(52) U.S. Cl.
CPC ..... *B65B 31/024* (2013.01); *B65B 9/067* (2013.01); *B65B 9/073* (2013.01); *B65B 51/146* (2013.01);
(Continued)

(58) Field of Classification Search
CPC .. B65B 5/02; B65B 9/06; B65B 9/067; B65B 9/073; B65B 9/10; B65B 9/13;
(Continued)

(56) References Cited

U.S. PATENT DOCUMENTS 3,744,210 A * 7/1973 O'Lenick et al. .... B65B 31/021 53/433
3,851,437 A * 12/1974 Waldrop et al. ..... B65B 31/024 53/434
(Continued)

FOREIGN PATENT DOCUMENTS

CH 447923 A * 11/1967 ..... B65B 9/06
EP 2886268 A1 6/2015
(Continued)

OTHER PUBLICATIONS

International Search Report in corresponding PCT Application No. PCT/EP2016/065017, dated Sep. 15, 2016.
(Continued)

*Primary Examiner* — Stephen F. Gerrity
(74) *Attorney, Agent, or Firm* — Edell, Shapiro & Finnan, LLC

(57) ABSTRACT

Method, machine and installation for vacuum packaging of products, where a plurality of individual bags closed at one end and open at the opposite end with at least one product therein are generated. For generating the bags, a transverse cut and a complete transverse seal on both sides of the transverse cut are made on the film tube, and a transverse cut without complete transverse seals on the sides thereof is made at a distance (L) substantially equal to the desired length of the bag to be generated from the transverse cut and seal on both sides. Each bag is oriented at 180 degrees with respect to the bag previously generated in the forward movement direction.

20 Claims, 8 Drawing Sheets

(51) Int. Cl.

| | |
|---|---|
| ***B65B 51/30*** | (2006.01) |
| ***B65B 9/067*** | (2012.01) |
| ***B65B 51/14*** | (2006.01) |
| ***B65B 61/08*** | (2006.01) |
| ***B65B 65/00*** | (2006.01) |
| ***B65B 9/073*** | (2012.01) |
| ***B65B 25/00*** | (2006.01) |
| ***B65B 57/06*** | (2006.01) |

(52) U.S. Cl.
CPC ..... *B65B 51/303* (2013.01); *B65B 51/306* (2013.01); *B65B 61/06* (2013.01); *B65B 61/065* (2013.01); *B65B 61/08* (2013.01); *B65B 65/003* (2013.01); *B65B 65/006* (2013.01); *B65B 25/001* (2013.01); *B65B 57/06* (2013.01)

(58) Field of Classification Search
CPC ... B65B 25/001; B65B 25/067; B65B 31/021; B65B 31/024; B65B 65/003; B65B 65/006
USPC ..... 53/433, 434, 450, 459, 469, 511, 512, 53/547, 550, 567, 568, 202
See application file for complete search history.

(56) References Cited

U.S. PATENT DOCUMENTS

| | | | | | |
|---|---|---|---|---|---|
| 4,242,852 | A * | 1/1981 | Orliaguet et al. | .... B65B 31/024 | 422/297 |
| 4,471,599 | A | 9/1984 | Mugnai | | |
| 4,601,159 | A * | 7/1986 | Mugnai | ..... B65B 31/021 | 53/511 |
| 4,640,081 | A | 2/1987 | Kawaguchi et al. | | |
| 4,870,802 | A | 10/1989 | Cerf | | |
| 5,347,793 | A * | 9/1994 | Cur et al. | ..... B65B 31/024 | 53/434 |
| 6,539,689 | B1 * | 4/2003 | Yoshimoto | ..... B65B 31/022 | 53/434 |
| 7,296,390 | B2 * | 11/2007 | Koke et al. | ..... B65B 31/024 | 53/202 |
| 2001/0011445 | A1 | 8/2001 | Scolaro | | |
| 2002/0083683 | A1 * | 7/2002 | Suga | ..... B65B 31/021 | 53/432 |
| 2002/0095913 | A1 * | 7/2002 | Honegger | ..... B65B 9/06 | 53/450 |
| 2005/0178090 | A1 | 8/2005 | Koke et al. | | |
| 2006/0045941 | A1 * | 3/2006 | Ogiue et al. | ..... B65B 31/024 | 426/106 |

FOREIGN PATENT DOCUMENTS

| | | | | |
|---|---|---|---|---|
| EP | 3115302 A1 | | 1/2017 | |
| EP | 3115302 B1 | | 5/2017 | |
| GB | 1562392 A | * | 3/1980 | ..... B65B 31/024 |
| GB | 2094707 A | * | 9/1982 | ..... B65B 31/024 |
| NL | 1007192 C2 | * | 4/1999 | ..... B65B 31/024 |

OTHER PUBLICATIONS

European Search Report in corresponding European Application No. 15382359.6, dated Nov. 16, 2015.

* cited by examiner

METHOD FOR VACUUM PACKAGING OF PRODUCTS

CROSS-REFERENCE TO RELATED APPLICATIONS

This application relates to and claims the benefit and priority to International Appl. No. PCT/EP2016/065017, filed Jun. 28, 2016, which relates to and claims the benefit and priority to European Appl. No. 15382359.6, filed Jul. 7, 2015. Each of International Appl. No. PCT/EP2016/065017 and European Appl. No. 15382359.6 are incorporated herein by reference in their entirety.

TECHNICAL FIELD

The present invention relates to methods, machines and installations for vacuum packaging of products.

BACKGROUND

Vacuum packaging of perishable food products is common. Vacuum packaging typically consists of enveloping the food (product) in a bag generated from a film tube in a horizontal packaging machine. The generated bag comprises a closed end and an opposite open end. The bags are then conveyed to a vacuum station where the bags are introduced in a vacuum chamber to complete the packaging.

In the packaging machine, the bags are generated one after the other in a longitudinal forward movement direction. The packaging machine comprises actuation means acting on the film tube containing products therein distributed in the forward movement direction in order to generate a transverse cut in the film tube and a complete transverse seal on one of the sides of the transverse cut. A bag is therefore separated from the rest of the film tube with a single operation (with the transverse cut), and depending on the side of the transverse cut on which the transverse seal is made, one end of said bag is left open and one end of the next bag to be generated is closed (with the transverse seal), or one end of said bag is closed (with the transverse seal) and one end of the next bag to be generated is left open, improving the productivity of said machine.

In the vacuum chamber, air is discharged from inside the bags through their open end and said open ends are then hermetically closed or sealed, generating independent closed packages comprising a vacuum packed product. The productivity of the packaging machine as mentioned has been improved, so the vacuum chamber operating time is usually longer than the time the packaging machine needs to generate bags with at least one product therein, the vacuum chamber therefore being an element slowing down the production rate in the complete packaging process.

Solutions to this problem by means of installations comprising a set of rotary vacuum chambers such as those disclosed, for example, in patent document U.S. Pat. No. 4,640,081A, are known in the state of the art. Such installations comprise a horizontal packaging machine as well as a plurality of vacuum chambers which, by means of the rotation of said vacuum chambers, receive the corresponding bag from the packaging machine to remove air from inside same and to seal the opening of the package. However, due to their configuration, such installations require a considerable size and thorough maintenance.

Patent document US20050178090A1 does not have rotary vacuum chambers. This patent document describes a vacuum packaging installation comprising a plurality of vertically arranged vacuum chambers. Hermetically closed bags loaded with two products therein are formed before the vacuum chamber in a horizontal packaging machine, and they are then longitudinally conveyed to the vacuum chamber. The vacuum chamber comprises a sealing tool arranged transverse to the product feeding direction, which is arranged around the bag, between the two products. The sealing tool makes a transverse cut between both products splitting the package into two independent bags with a product inside each bag and with one opening at one end of each bag. Air is removed from inside the bags through the openings and they are then hermetically sealed, both vacuum packed products being in individual packages. Since there is more than one vacuum chamber, while the packaging operation is being performed in one of them, the other can be loaded, therefore improving productivity.

Such installations, however, involve using a plurality of vacuum chambers if productivity is to be improved, making the installation more expensive. Furthermore, the vacuum chambers are complex since they have to carry out other tasks such as receiving a bag after performing a circular path or cutting the package in half, which entails a complex and more expensive installation as well as a more thorough maintenance.

To prevent these drawbacks, other solutions using conventional vacuum chambers 800 which are simpler and more cost-effective, such as those shown, for example, in the packaging installation 1000" depicted in FIG. 1, are known. Such vacuum chambers 800 comprise a sealing tool 801 that extends longitudinally in the vacuum chamber 800 and is suitable for closing the openings of the bags 1" with products P" which are generated by a horizontal packaging machine 100" and introduced in the vacuum chamber 800, after removing air from inside same. Therefore, increasing the capacity of the vacuum chamber 800 itself (its size and the longitudinal size of the sealing tool 801) to enable housing a larger number of bags 1" is sufficient to increase productivity. In the packaging installations 1000" of the type shown in the example of FIG. 1, the opening of the bags 1" must be suitably oriented with respect to the sealing tool 801, for which the bag 1" is generally rotated 90° when the vacuum chamber 800 is arranged parallel to the longitudinal forward movement direction of the packaging machine 100", or the bags 1" are fed transverse to the vacuum chamber 800 when said vacuum chamber 800 is arranged perpendicular to the forward movement direction of the packaging machine 100" by means of suitable conveyance means 805 (configuration shown in FIG. 1). The bags can gradually accumulate at the inlet of an accumulator 804, forming a line L". With this solution, installation complexity is simplified and its cost reduced, while at the same time its productivity can be increased.

Based on this vacuum chamber design, in order to at least make use of the described advantages, solutions increasing the capacity of vacuum chambers without excessively increasing their cost or complexity, and without excessively increasing their size, are also known. One example is shown in the packaging installation 1000' depicted by way of example in FIG. 2. The vacuum chamber 900 of said installation is fed with two lines L1' and L2' of bags 1' parallel to one another and generated in a packaging machine 100', and it comprises a longitudinal sealing tool 901 for each line L1' and L2'. The sealing tools 901 are arranged at the transverse ends of the vacuum chamber 900, such that the openings of each pair of parallel bags 1' with products P' reaching the vacuum chamber 900 of lines L1' and L2' are arranged for being actuated by the corresponding sealing tools 901 of the vacuum chamber 900, said pairs of bags 1' being oriented at 180° with respect to one another (i.e., the open or closed ends of both bags 1' are facing one another).

In these installations, the products leave the horizontal packaging machine 100' one by one towards the vacuum chamber 900, in a linear manner, loaded in bags with an opening at one of the ends thereof. All the bags loaded with products leave the packaging machine 100' with the same orientation, such that the installation comprises means for suitably orienting said bags for their introduction in the vacuum chamber 900.

When the vacuum chamber 900 is arranged parallel to the forward movement direction of the packaging machine (a situation not shown in the drawings), said means comprises a rotating device for rotating the bags 90°, and a divider generating two parallel lines of bags. The rotating device causes a bag to rotate 90° in one direction and arranges it in one of the lines, and the next bag to rotate 90° in the opposite direction and arranges it in the other line. Once these two bags are arranged in the two lines (with the closed ends facing one another), both lines of the divider are made to move forward in order to move said bags closer to the vacuum chamber and make room for two new bags.

When the vacuum chamber 900 is arranged perpendicular to the forward movement of the packaging machine 100' as shown by way of example in FIG. 2, the means for suitably orienting the bags comprises a divider 902 which alternately directs the bags coming from the packaging machine 100' to two different paths 905*a* and 905*b*, such that the bags reach a feeder 903 of the sealing station after travelling different paths 905*a* and 905*b*. Each path 905*a* and 905*b* suitably orients the corresponding bags: path 905*a* maintains the orientation it has at the outlet of the packaging machine 100', and path 905*b* causes the bags to rotate 180°. Therefore, in the feeder 903, bags coming from the path 905*a* are arranged in line L1' and bags coming from the other path 905*b* are arranged in the other parallel line L2', and said feeder 903 feeds the bags in twos to an accumulation belt 904 before the vacuum chamber 900, so that once a given number of bags have accumulated on the accumulation belt 904, they are introduced in the vacuum chamber 900.

Such installations therefore allow increasing installation productivity by increasing the vacuum chamber packaging capacity.

SUMMARY OF THE DISCLOSURE

A first aspect of the invention relates to a method for vacuum packaging of products, in which a plurality of individual bags closed at one end and open at the opposite end with at least one product therein are generated, from a film in the form of a film tube enveloping therein a plurality of products distributed longitudinally in a forward movement direction.

For generating bags, a transverse cut and a complete transverse seal on both sides of the transverse cut are made on the film tube with respect to the forward movement direction, in a first area of the film tube between two adjacent products, and a transverse cut without complete transverse seals on the sides thereof is also made in a second area of the film tube between two adjacent products, separated from the first area in the forward movement direction by a distance substantially equal to the desired length of the bag to be generated, the generated bag being the part of the film tube with at least one product therein remaining between both transverse cuts. Therefore, actuations on the film tube (transverse cut with seals on the sides thereof and transverse cut without seals on the sides thereof) are performed such that each generated bag is oriented 180° with respect to the subsequently generated bag (the open end of a bag is facing the open end of the previously generated bag, or the closed end of said bag is facing the closed end of the previously generated bag).

The bags are therefore generated with an orientation with respect to one another that eliminates the need for using specific means for suitably orienting them like in the state of the art, for subsequently completing vacuum packaging, for the purpose of increasing productivity. Therefore, the method of the invention makes a packaging installation in which products are vacuum packed simpler, more compact and less expensive.

A second aspect of the invention relates to a horizontal packaging machine for vacuum packaging of products. The horizontal packaging machine is suitable for generating a plurality of individual bags closed at one end and open at the opposite end with at least one product therein, from a film in the form of a film tube enveloping therein a plurality of products distributed longitudinally in a forward movement direction. The machine comprises actuation means for acting on a film tube and for generating with the actuation thereof the plurality of bags.

The actuation means IS configured for making a transverse cut and a complete transverse seal on both sides of the transverse cut with respect to the forward movement direction, in a first area of the film tube between two adjacent products, and for making a transverse cut without complete transverse seal on the sides thereof in the forward movement direction, in a second area of the film tube between two adjacent products separated from the first area in the forward movement direction by a distance substantially equal to the desired length of the bag to be generated, the generated bag being the part of the film tube with at least one product therein remaining between both transverse cuts. The machine further comprises a control unit suitable for controlling the actuation of the actuation means, and configured so that the actuation of said actuation means on the film tube causes each generated bag to be oriented at 180° with respect to the subsequently generated bag (the open end of a bag is facing the open end of the previously generated bag, or the closed end of said bag is facing the closed end of the previously generated bag). The machine of the invention therefore allows obtaining at least the advantages mentioned above with respect to the first aspect of the invention.

A third aspect of the invention relates to a packaging installation comprising at least one horizontal packaging machine generating a plurality of individual bags closed at one end and open at the opposite end with at least one product therein, each generated bag being oriented at 180° with respect to the subsequently generated bag, a vacuum station comprising means for removing air from the bags generated in the packaging machine and sealing means for sealing the open end of said bags generating independent packages with vacuum packed products, and a conveyance unit suitable for receiving the bags generated in the packaging machine and for feeding said bags to the vacuum station. The installation of the invention allows obtaining at least the advantages mentioned above with respect to the first aspect of the invention in an installation suitable for generating packages with vacuum packed products.

These and other advantages and features of will become evident in view of the drawings and the detailed description.

DETAILED DISCLOSURE OF THE INVENTION

Figure 3:
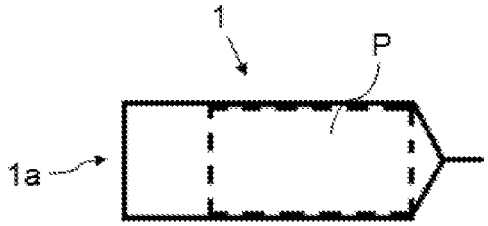
FIG. 3 shows, by way of example, a side view of an embodiment of a bag generated with the method of the invention.
Figure 4:
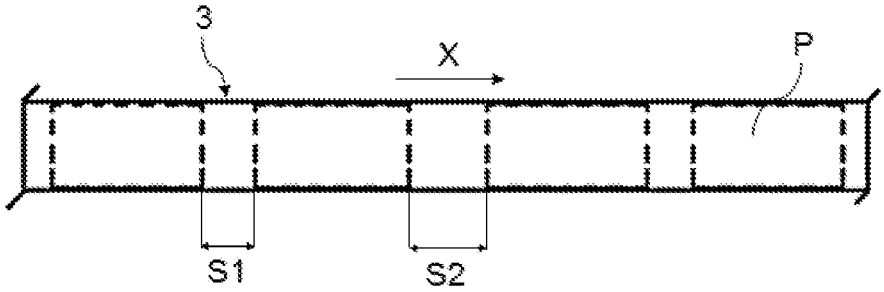
FIG. 4 shows, by way of example, a side view of an embodiment of a film tube from which the bags of FIG. 3 are generated with the method of the invention.

A first aspect of the invention relates to a method for vacuum packaging of products. A plurality of individual bags 1 closed at one end and open at the opposite end with at least one product P therein, such as that shown by way of example in FIG. 3, are generated in the method. Each bag 1 is closed at one end and open at the opposite end in a forward movement direction X, having an opening 1*a* at said open end through which the inside of said bag 1 can be accessed. Said bags 1 are preferably generated from a film in the form of a film tube 3 enveloping therein a plurality of products P distributed longitudinally in the forward movement direction X, as shown by way of example in FIG. 4. Although the drawings show a single product P inside a bag 1, the content of a bag 1 can also be formed by a plurality of products P (same or different). For the sake of clarity, a single product P will be referred to hereinafter without this being limiting in any way.

The end of the bag 1 through which the inside thereof is accessed is preferably completely open (complete transverse opening), but it could also be only partially open (partial transverse opening or partial transverse openings), i.e., said end can comprise sealed parts and open parts (partial transverse openings, or two partial transverse seals and an open part between the two seals), so that said open end (partially open in this case) behaves in a stable manner during subsequent handling of the bag. Therefore, although "open end" is used throughout the description for the sake of clarity, it must be taken into account that in the context of the invention in any of the aspects thereof, an "open end" must be interpreted as being "completely open" or "partially open".

Figure 5:
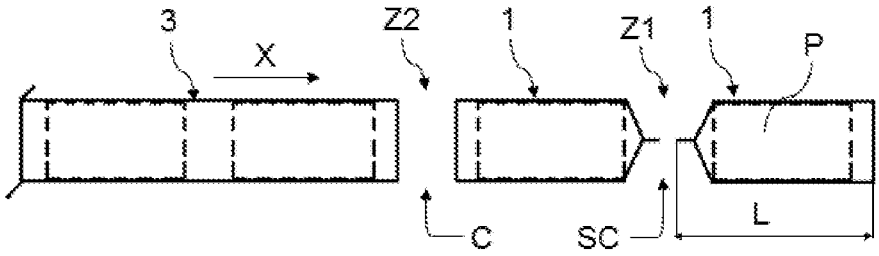
FIG. 5 shows, by way of example, a side view of an embodiment of the result of the two operations performed on the film tube in the method of the invention to generate bags such as those of FIG. 3.

For generating a bag 1 with the method of the invention, at least two operations are performed on the film tube 3. On one hand, a transverse cut of the film tube 3 and a complete transverse seal on both sides of the transverse cut with respect to the forward movement direction X are made in a first area Z1 of the film tube 3 arranged between two adjacent products P (the result of this operation is referred to as SC in FIG. 5), and on the other hand, a transverse cut without complete transverse seals on the sides thereof is made in a second area Z2 of the film tube 3 separated from the first area Z1 in the forward movement direction X by a distance L substantially equal to the desired length of the bag 1 to be generated (the result of this operation is referred to as C in FIG. 5). The part remaining between both transverse cuts corresponds with a generated bag 1. The two operations are performed such that each generated bag 1 is oriented at 180° with respect to the subsequently generated bag 1 (as shown in FIG. 5, for example, the open end of a bag 1 is facing the open end of the previously generated bag 1, or the closed end of said bag is facing the closed end of the previously generated bag).

Figure 1:
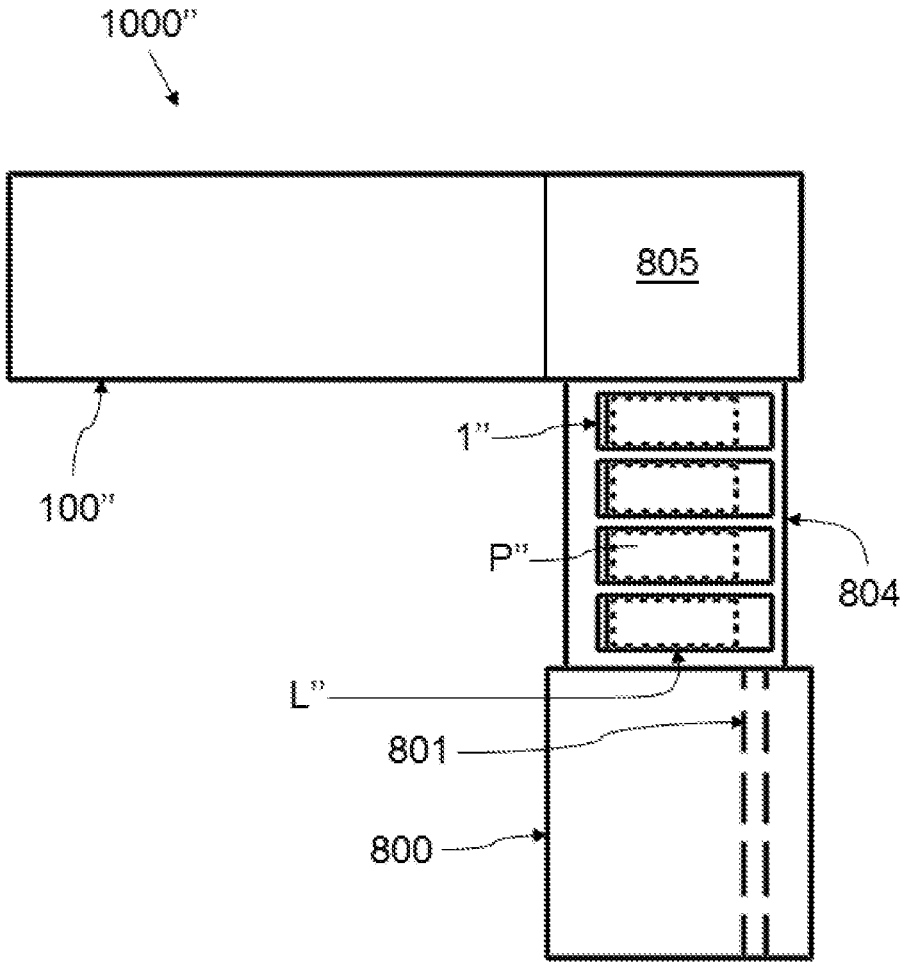
FIG. 1 (Prior Art)
FIG. 1 shows a schematic plan view of a packaging installation of the state of the art.
Figure 2:
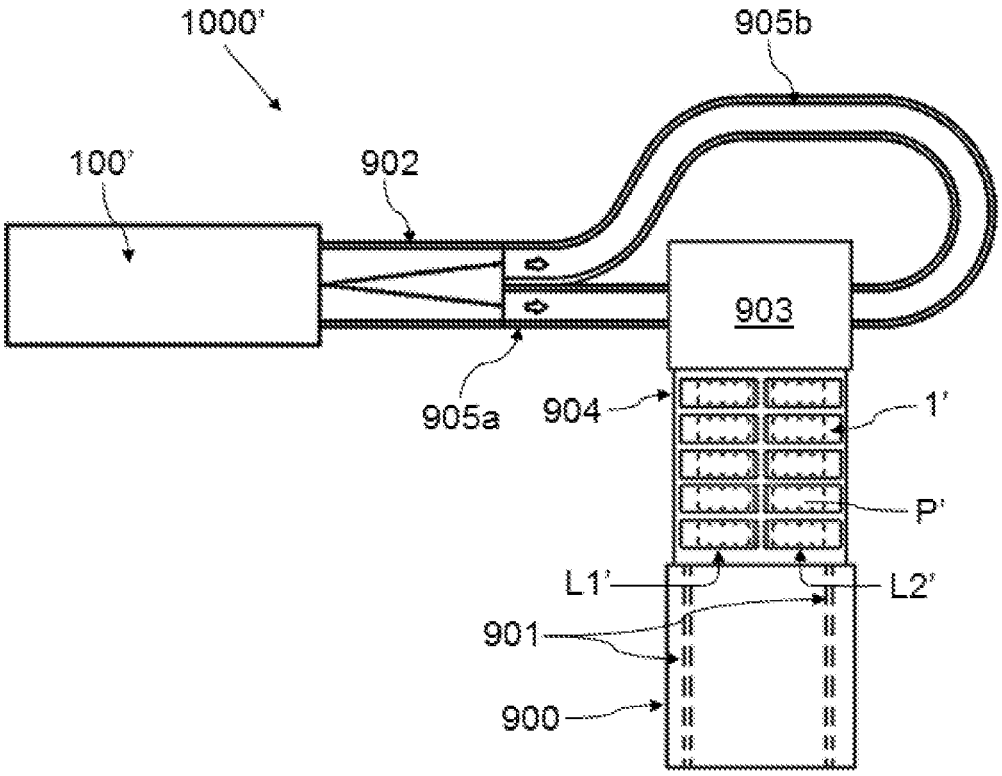
FIG. 2 (Prior Art)
FIG. 2 shows a schematic plan view of another packaging installation of the state of the art.

Each bag 1 is therefore generated with an orientation with respect to its adjacent bags 1 that eliminates the need for using specific means for suitably orienting them like in the state of the art (divider 902 and independent paths 905*a* and 905*b* shown in FIG. 2), for subsequently completing packaging, for the purpose of increasing productivity. Therefore, the method of the invention allows a simpler, more compact and less expensive packaging installation 1000 in which products P are vacuum packed with said method.

In some embodiments of the method, actuations on the first area Z1 and the second area Z2 of the film tube 3 are performed simultaneously. This requires using actuation means comprising at least two blades (one for each transverse cut) separated in the forward movement direction X by a distance L equal to the desired length for the bag 1 to be generated, and a sealing tool associated with one of the blades for making the complete transverse seals on both sides of one of the transverse cuts, and the synchronization between the blades and the sealing tool. The simultaneous actuation could be performed while the film tube 3 is moved in the forward movement direction, such that the actuation means is moved at the same time and at the same speed as the film tube 3. This would allow the actuation means to act on the film tube 3 long enough to complete their actuations, without this negatively affecting productivity. The actuation means would then be moved in the direction opposite the forward movement direction X to return to its original position and thus be ready for the next actuation. In other embodiments in which the actuations on the first area Z1 and the second area Z2 of the film tube 3 are also performed simultaneously, the actuation means is not moved in the forward movement direction X (nor in the opposite direction), such that the film tube 3 remains static during the actuation of said actuation means.

In other embodiments of the method, both actuations on the film tube 3 are performed sequentially, like what occurs in the preferred embodiment, for example. In the preferred embodiment, both transverse cuts are made by means of one and the same cutting tool 103*a* (a blade, for example) of the actuation means 103, and the transverse seal is made by means of a sealing tool 103*b* of said actuation means 103, as shown by way of example in FIGS. 6*a*-6*c*, as will be described in detail below.

In the preferred embodiment, the actuation means 103 is furthermore moved in the forward movement direction X and in the opposite direction. In said preferred embodiment, the film tube 3 moves in the forward movement direction X when the actuation means acts thereon (at a constant speed or reducing its speed for the actuation means 103 to act thereon), and said actuation means 103 is moved in said forward movement direction X along with the movement of the film tube 3. The actuation means 103 therefore acts on said film tube 3 for the amount of time necessary to suitably complete its actuation, without it negatively affecting productivity. After completing its actuation, the actuation means 103 separates from the film tube 3 and returns to its initial position, moving backwards in the direction opposite the forward movement direction X. In other embodiments in which the actuations on the film tube 3 are also performed sequentially and in which both transverse cuts are made by means of one and the same cutting tool, the cutting tool may not move in the forward movement direction X and in the opposite direction, the film tube 3 being stopped when the actuation means acts thereon and said film tube 3 being moved a distance L equal to the desired length for the bag 1 to be generated in the forward movement direction X.

In other embodiments in which the actuations on the film tube 3 are also performed sequentially, the actuation means may have two independent cutting tools acting sequentially on said film tube 3, the sealing tool being associated with one of them. The actuations on the film tube 3 could be performed with moving film tube 3 or with stopped film tube 3, as described also for the preferred embodiment.

In the preferred embodiment, the actuation means is furthermore moved in the forward movement direction X and in the opposite direction. In said preferred embodiment, the film tube 3 moves in the forward movement direction X when the actuation means acts thereon, and said actuation means is moved in said forward movement direction X along with the movement of the film tube 3. The actuation means therefore acts on said film tube 3 for the amount of time necessary to suitably complete their actuation, without it negatively affecting productivity. After completing its actuation, the actuation means separates from the film tube 3 and returns to its initial position, moving backwards in the direction opposite the forward movement direction X.

In the preferred embodiment, the products P are introduced in the film tube 3 during the movement of said film tube 3. Said products P are arranged in the film tube 3 with a gap S1 between the products P which are subsequently housed in two adjacent bags 1 the closed ends of which are facing one another, and with a gap S2 between the products P which are subsequently housed in two adjacent bags 1 the open ends of which are facing one another, the gap S2 being different from the gap S1. Therefore, a product P is arranged with a gap S1 with respect to product P, if said preceding product P has been arranged with a gap S2 with respect to its preceding product P, and vice versa (gaps S1 and S2 are therefore produced alternately). The gaps S1 and S2 can go, for example, from the end of a product P to the start of the next product P, as shown in the drawings, the end and start of the products P being able to be detected by means of a photocell, for example (not depicted in the drawings). The gap S1 is smaller than the gap S2 such that a savings in film is allowed. The facing ends of the bags 1 separated by the gap S2 are open ends requiring a given separation between them to allow the subsequent air removal and sealing operations. However, the facing ends of the bags 1 separated by the gap S1 are closed ends and do not need to allow said operations, so they can be closer to one another (making the gap S1 smaller with respect to gap S2), there being a smaller amount of film between both ends as a result, thereby entailing savings in the amount of film used.

Figure 7:
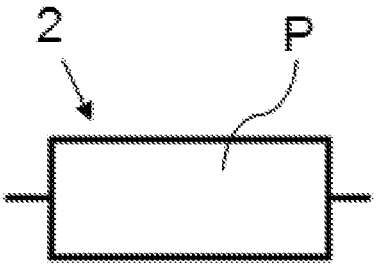
FIG. 7 shows a side view of an embodiment of a package with a vacuum packed product P generated with the method of the invention.
Figure 8:
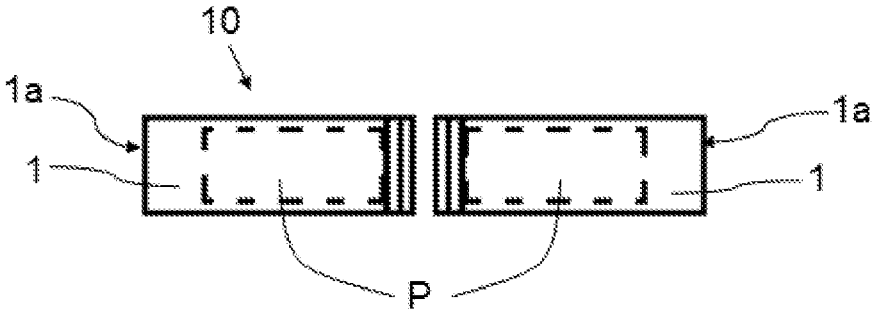
FIG. 8 shows a side view of an embodiment of the group formed by two bags oriented at 180° with respect to one another, and generated with the method of the invention.
Figure 9:
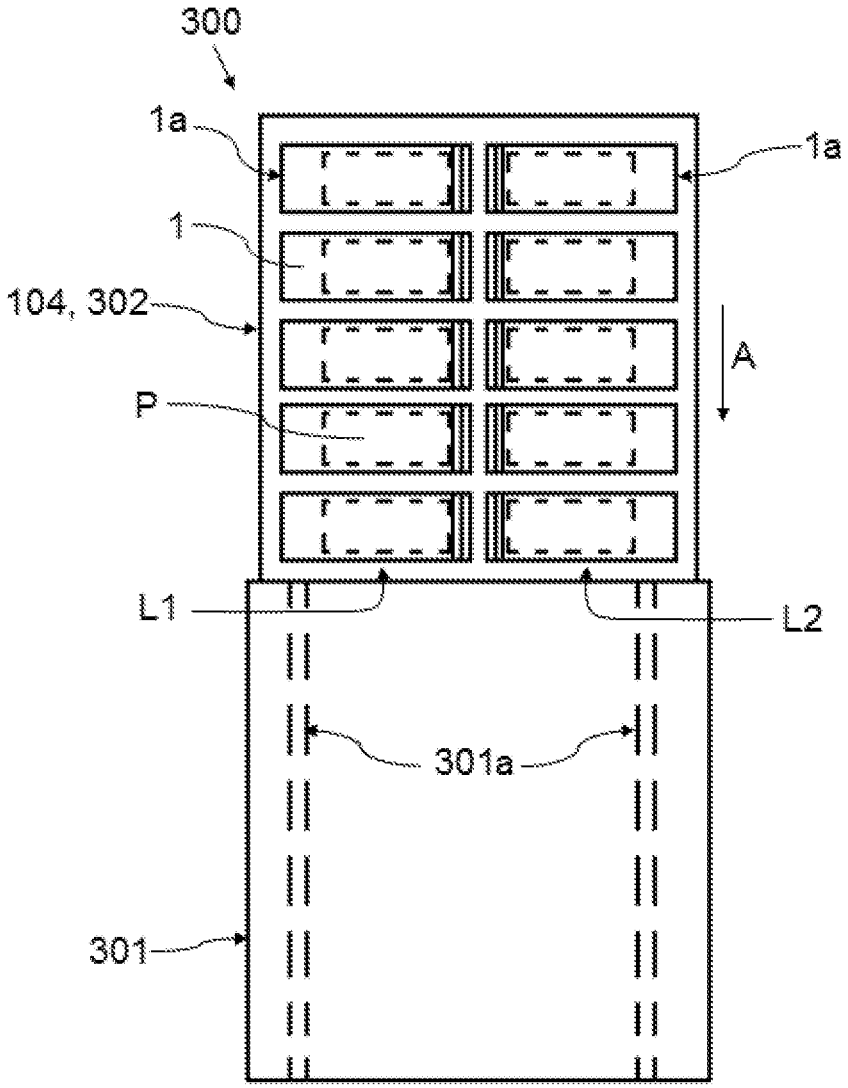
FIG. 9 shows, by way of example, the accumulation of bags generated with the method of the invention on conveyance means of a vacuum station of an embodiment of the packaging installation of the invention, forming two parallel lines, in which an embodiment of a vacuum chamber is depicted in a simple and schematic manner showing sealing means.

According to some embodiments the bags 1 generated one after the other are arranged in twos in two different parallel lines L1 and L2 on conveyance means 104 (a conveyor belt, for example), the bags 1 of one line L1 being oriented at 180° with respect to the bags 1 of the other line L2, as shown in FIG. 9 by way of example. Air is then removed from said bags 1 through their open end and said open end is sealed, independent packages 2 with vacuum packed products P therein being generated, as shown by way of example in FIG. 7. As depicted in said FIG. 7, after vacuum packaging the film of the bag 1 adheres to the product P, such that surplus film is barely seen in the package 2. Air removal from the bags 1 and the sealing thereof are performed in a vacuum station 300, specifically in a vacuum chamber 301 of the vacuum station 300, and the removal and sealing are performed simultaneously on the bags 1 arranged in both lines L1 and L2, increasing productivity. Each group 10 formed by two bags 1, shown by way of example in FIG. 8, which is arranged on the conveyance means 104 is moved in a direction A longitudinal to the conveyance means 104 to allow arranging another group 10 on said conveyance means 104. Groups 10 of bags 1 arranged one after the other therefore accumulate on the conveyance means 104, forming two lines L1 and L2 of bags 1. When a specific number of groups 10 accumulate on the conveyance means 104, said conveyance means 104 introduce said groups 10 in the vacuum chamber 301 simultaneously.

In some embodiments, the bags 1 generated one after the other are arranged in twos, in two different parallel lines L1 and L2, by means of a 90° rotation with respect to the forward movement direction X, but in other embodiments, such as in the preferred embodiment for example, this arrangement can be carried out by means of a translational movement transverse to the forward movement direction X of the groups 10 formed by two bags 1, for example.

The length L of the bag can be determined by the length of the product P to be packed. The photocell detects the start of the product P when it is introduced in the film tube 3 and in turn detects the end thereof once the product P inside the film tube 3 moves forward. Therefore, the control unit can determine the length L of the bag 1 to be generated depending on the detected length of the product P (and pre-established margins if this is the case) to achieve gaps S1 and S2. Furthermore, the case in which the sum of the lengths L of two bags 1 generated one after the other and oriented at 180° exceeding the distance between the two sealing tools 301*a* of the vacuum station 300 can occur. Therefore, when this particular case occurs, the control unit does not arrange said bags 1 in twos in the feeder 302 (because they would not enter the vacuum chamber 301), and arranges them in a staggered manner in the longitudinal direction A (only those pairs of bags 1 the lengths of which exceed the distance between the sealing tools 301*a*), arranging a first bag 1 in one row and the second bag 1 in the other row once the feeder 302 moves the first bag 1 forward and has space for the second bag 1.

The second aspect of the invention relates to a horizontal packaging machine 100 suitable for generating bags 1 described in the first aspect of the invention. The packaging machine 100 is suitable for generating a plurality of individual bags 1 with at least one product P therein, as previously described, and comprises actuation means 103 for performing the required actuations on the film tube 3, and a control unit (not depicted in the drawings) which is suitable for controlling said actuation of the actuation means 103. The control unit is configured at least so that the actuation of said actuation means 103 on the film tube 3 causes each generated bag 1 to be oriented at 180° with respect to the subsequently generated bag 1.

Figure 6A:
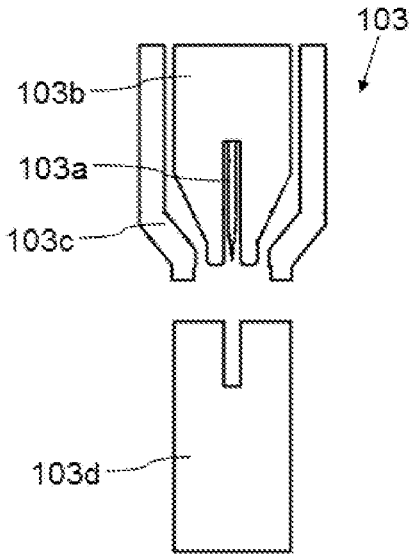
FIG. 6*a* shows actuation means of a preferred embodiment of the packaging machine of the invention, in a position in which the actuation means is not acting on a film tube.
Figure 6B:
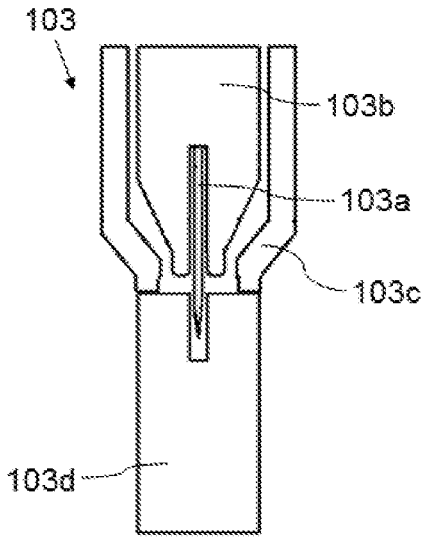
FIG. 6*b* shows the actuation means of FIG. 6*a*, in a position in which it generates a cut on a film tube without complete transverse seals.
Figure 6C:
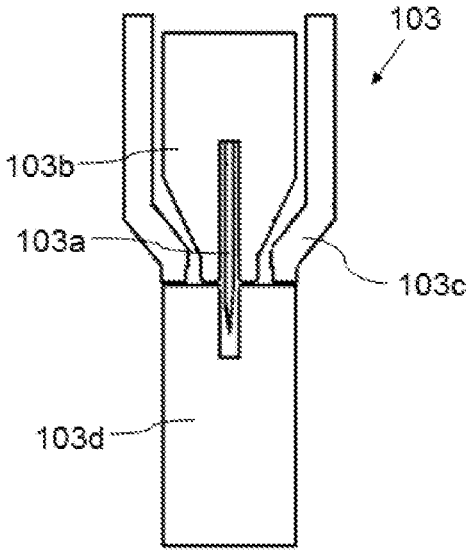
FIG. 6*c* shows the actuation means of FIG. 6*a*, in a position in which it generates a cut on a film tube and complete transverse seals on the sides of the cut.

In some embodiments of the packaging machine 100, such as for example, in a preferred embodiment, the control unit is configured so that the actuation means 103 implements the preferred embodiment of the method of the invention, and the actuation means 103 comprises a cutting tool 103*a* for making the transverse cut and a sealing tool 103*b* for making the complete transverse seal on both sides of said transverse cut, as shown by way of example in FIGS. 6*a*-6*c*. Both tools 103*a* and 103*b* are configured for moving independently, the control unit being configured for causing the movement of both tools 103*a* and 103*b* when the actuation means 103 has to make a transverse cut and a complete transverse seal on both sides of the transverse cut (FIG. 6*c*), and for causing the movement of the cutting tool 103*a* to make the transverse cut without the sealing tool 103*b* forming a seal in the film tube (FIG. 6*b*). The actuation means 103 can further comprise a hold-down plate for keeping the film tube 3 in place during the actuation of the cutting tool 103*a* (and, where appropriate, of the sealing tool 103*b*) and assuring correct actuation, the hold-down plate comprising two opposite segments 103*c* and 103*d* (one on each side of the film tube 3 and facing one another). In the preferred embodiment, the packaging machine 100 comprises at least one actuator (not depicted in the drawings) to cause the actuation of each tool 103*a* and 103*b*. In this case, if the open end of the bag 1 is a partially open end, the actuation means would comprise a sealing tool suitable for partially sealing said end (for example, at least one sealing tool, between the sealing tool 103*b* and the segment 103*c* of the hold-down plate, which moves integrally with the hold-down plate 103*c* or with the cutting tool 103*a* when acting on the film tube 3 to generate said partial seal at said end).

Figure 10:
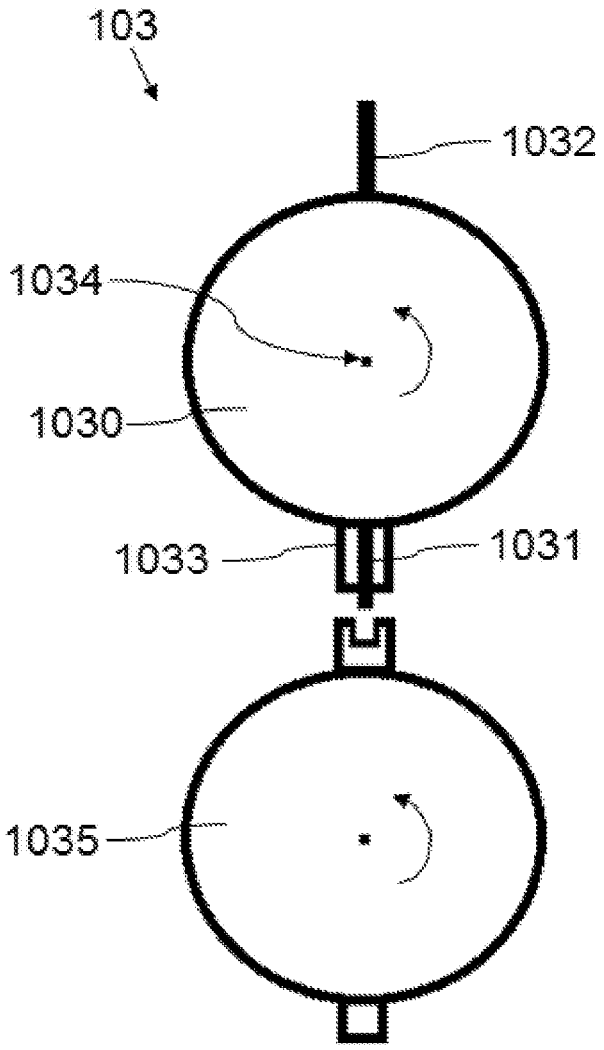
FIG. 10 schematically shows rotary actuation means of an embodiment of a packaging machine of the invention.

In other embodiments of the packaging machine 100, the actuation means comprises different configurations, such as those shown by way of example in FIG. 10 (rotary actuation means 103), comprising a rotary support 1030 that is rotational with respect to a rotating shaft 1034, two cutting tools 1031 and 1032 fixed in positions opposite the support 1030, a sealing tool 1033 associated with one of the cutting tools 1031 and 1032, and a rotary hold-down plate 1035. Generally, any of the known actuation means of the state of the art could be used, adapting same so that an operation on the film tube 3 involving a transverse cut without complete transverse seals on the sides thereof in the forward movement direction X, and another operation on said film tube 3 involving a transverse cut and complete transverse seals on the sides thereof, can be made. In this case, if the open end of the bag 1 was a partially open end, the actuation means would comprise a sealing tool suitable for partially sealing said end (for example, a partial or discontinuous sealing tool associated with the cutting tool 1032, other than the associated continuous sealing tool 1033).

In other embodiments of the packaging machine 100, the actuation means comprises two cutting tools separated in the forward movement direction X by a distance equal to the desired length for each bag 1, a sealing tool associated with one of the cutting tools for making complete transverse seals, and an actuator to cause the simultaneous movement of all the tools. In this case, if the open end of the bag 1 was a partially open end, the actuation means would comprise a sealing tool suitable for partially sealing said end (for example, a sealing tool associated with the hold-down plate or the cutting tool which does not have a sealing tool associated therewith for making complete transverse seals).

In any of the embodiments of the packaging machine 100, the control unit is furthermore configured for arranging a product P in the film tube 3 with a gap S1 with respect to the preceding product P, or with a gap S2 with respect to the preceding product P, as previously described for the first aspect of the invention.

In the preferred embodiment of the packaging machine 100, the control unit causes the continuous movement of the film tube 3 and the arrangement of the products P therein during said movement, at a suitable distance with respect to one another, and is furthermore configured to cause movement of the actuation means 103 in the forward movement direction X along with the film tube 3 during the actuation of said actuation means 103 on said film tube 3, and to cause backward movement of said actuation means 103 in the direction opposite said forward movement direction X between one actuation on the film tube 3 and another.

In other embodiments of the packaging machine 100, the control unit is furthermore configured for causing the film tube 3 and the products P enveloped in said film tube 3 to move forward a distance L substantially equal to the desired length of the bag 1 to be generated, between one actuation of the actuation means 103 on the film tube 3 and another, and for arranging the products P in the film tube 3 during said movement at a suitable distance with respect to one another. In these embodiments, the control unit does not cause movement of the actuation means 103 in the forward movement direction X or in the direction opposite said forward movement direction X.

Figure 11:
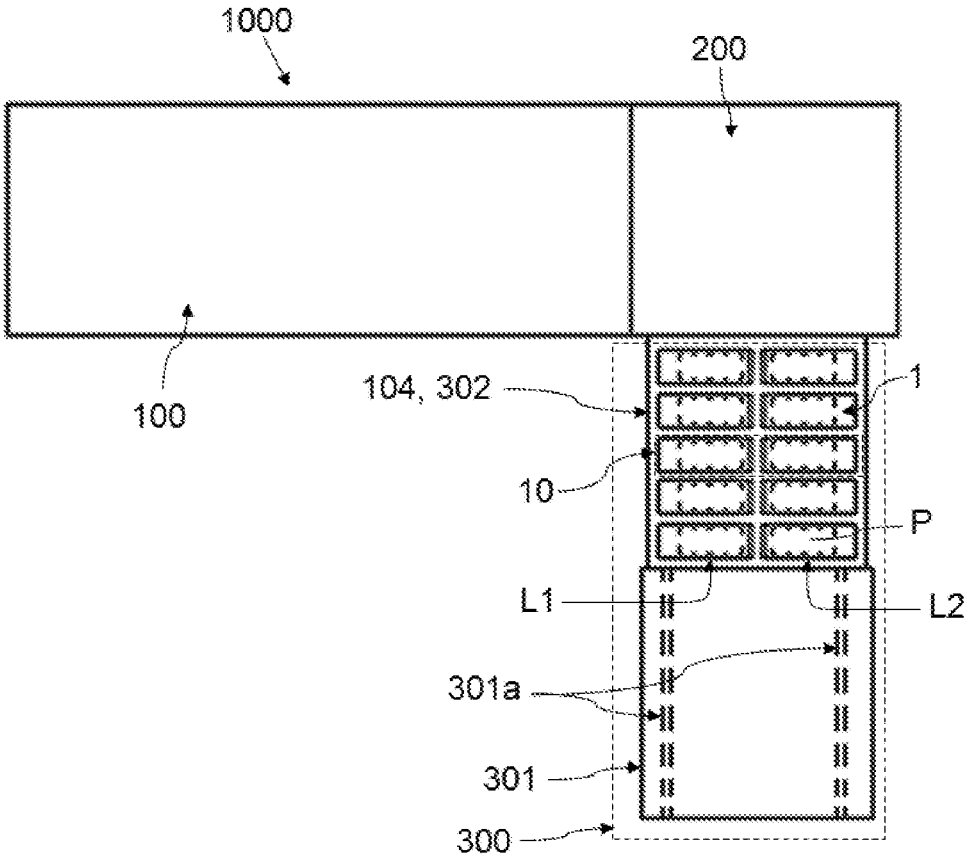
FIG. 11 schematically shows a plan view of a preferred embodiment of the packaging installation of the invention.

A third aspect of the invention relates to a packaging installation 1000 suitable, for example, for carrying out the method of the first aspect of the invention, as shown in FIG. 11. The packaging installation 1000 comprises a horizontal packaging machine 100 according to the second aspect of the invention, and a vacuum station 300 in which air is removed from inside the bags 1 generated in the packaging machine 100 and in which the open end of said bags 1 is sealed.

The vacuum station 300 comprises a feeder 302 where groups 10 of bags 1 are arranged and comprising conveyance means 104, and a vacuum chamber 301 in which removal and sealing operations are performed, independent packages 2 with vacuum packed products P being generated. The vacuum chamber 301 comprises means for removing air and sealing means 301*a* for making the seal. The vacuum chamber 300 comprises two parallel sealing tools 301*a*, one for each line L1 and L2 of bags 1, extending longitudinally in the vacuum chamber 301, such that each sealing tool 301*a* is responsible for simultaneously sealing the openings 1*a* of the bags 1 of the corresponding line L1 and L2. In a preferred embodiment, both sealing tools 301*a* act simultaneously on the bags 1, reducing production times.

The packaging installation 1000 further comprises a conveyance unit 200 between the packaging machine 100 and the sealing station 300 which is suitable for receiving the bags 1 generated in the packaging machine 100 and for feeding said bags 1 to the vacuum station 300 in twos. In some embodiments, the conveyance unit 200 receives the bags 1 generated in the packaging machine 100 one after the other and arranges them in twos simultaneously and jointly by means of a 90° rotation with respect to the forward movement direction X, for feeding the vacuum station 300 with bags 1 distributed in two lines L1 and L2, the bags 1 of one line L1, L2 being oriented at 180° with respect to the bags 1 of the other line L1, L2. The conveyance unit 200 arranges the open ends of the bags 1 aligned with the sealing means 301*a* of the vacuum station 300 (the open ends of each line L1 and L2 with their corresponding sealing means 301*a*).

In some embodiments like in the preferred embodiment, for example, the conveyance unit 200 receives the bags 1 generated in the packaging machine 100 one after the other and arranges them in twos simultaneously and jointly by means of transverse translational movement of said bags 1 with respect to the forward movement direction X, for feeding the vacuum station 300 with bags 1 distributed in two lines L1 and L2, the bags 1 of one line L1, L2 being oriented at 180° with respect to the bags 1 of the other line L1, L2. The conveyance unit 200 arranges the open ends of the bags 1 aligned with the sealing means 301*a* of the vacuum station 300 (the open ends of each line L1 and L2 with their corresponding sealing means 301*a*).

What is claimed is:

1. A method for vacuum packaging of products, the method comprising:

placing into a longitudinal film tube a plurality of products so that the plurality of products are longitudinally spaced-apart from one another, each of the plurality of products having a proximal end and a distal end;

transversely cutting the longitudinal film tube to form a plurality of bags that each contain one of the plurality of products, producing a complete transverse seal on a first end of each of the plurality of bags so that the first end is a closed end, the second end being an open end, the formation of the closed ends and open ends resulting in the closed ends of adjacent bags of the plurality of bags facing one another and in the open ends of adjacent bags of the plurality of bags facing one another, such that the plurality of bags are oriented 180 degrees with respect to one another.

2. The method according to claim 1, wherein each of the plurality of bags is formed by a first transverse cut at a first longitudinal location in the longitudinal film tube and by a second transverse cut at a second longitudinal location in the longitudinal film tube, a distance between the first and second longitudinal locations being substantially equal to a predetermined length of the plurality of bags.

3. The method according to claim 2, wherein the first ends of adjacent bags are formed in part by the first transverse cut at the first longitudinal location and the second ends of adjacent bags are formed in part by the second transverse cut at the second longitudinal location.

4. The method according to claim 3, wherein the plurality of products includes first, second, third and fourth products, the distal end of the first product and the proximal end of the second product being separated by a first gap inside the longitudinal film tube, the distal end of the second product and the proximal end of the third product being separated by a second gap inside the longitudinal film tube, the distal end of the third product and the proximal end of the fourth product being separated by a third gap inside the longitudinal film tube, each of the first and third gaps having a first length, the second gap having a second length that is greater than the first length.

5. The method according to claim 4, wherein the first longitudinal location is located in the first gap and the second longitudinal location is located in the second gap.

6. The method according to claim 2, wherein the first and second transverse cutting of the longitudinal film tube is performed sequentially.

7. The method according to claim 2, wherein during or after the first and second transverse cutting of the longitudinal film tube in the first and second longitudinal locations, the longitudinal film tube and the plurality of products located therein are made to move in a forward direction by a distance substantially equal to the predetermined length.

8. The method according to claim 7, wherein the first and second transverse cutting of the longitudinal film tube is made by a cutting apparatus during the moving of the longitudinal film tube in the forward direction, the cutting apparatus being moved in the forward direction along with the longitudinal film tube.

9. The method according to claim 8, wherein after the longitudinal film tube and cutting apparatus have been advanced in the forward direction, the cutting apparatus is moved in a backward direction opposite the forward direction.

10. The method according to claim 1, wherein the plurality of bags are generated one after the other and are thereafter arranged along first and second lines that are parallel to one another with a first set of the plurality of bags being positioned in the first line and a second set of the plurality of bags being positioned in the second line, the first set of bags being oriented 180 degrees with respect to the second set of bags.

11. The method according to claim 10, further comprising removing air from the plurality of bags inside a vacuum chamber, the air being removed from the open ends of the plurality of bags, and further comprising completely sealing the open ends of the plurality of bags after the air has been removed.

12. The method according to claim 10, wherein the plurality of bags are generated one after the other in a forward movement direction, the method further comprising rotating each of the plurality of bags 90 degrees with respect to the forward movement direction prior to being placed in one of the first and second lines.

13. The method according to claim 12, wherein the first and second lines of bags are simultaneously formed by use of a conveyance station that rotates each of the plurality of bags 90 degrees with respect to the forward movement direction.

14. The method according to claim 10, wherein the plurality of bags are generated one after the other in a forward movement direction, the method further comprising placing each of the plurality of bags in one of the first and second lines, the first and second lines being non-parallel to the forward movement direction.

15. The method according to claim 14, wherein the first and second lines are arranged orthogonal to the forward movement direction.

16. The method according to claim 14, wherein the first and second lines of bags are simultaneously formed by use of a conveyance station that places each of the plurality of bags in one of the first and second lines, in pairs.

17. The method according to claim 1, wherein the closed ends of adjacent bags are formed by use of a single cutting apparatus and a single sealing apparatus, the cutting apparatus and the sealing apparatus being configured to move independently of one another.

18. The method according to claim 17, wherein the single cutting apparatus is located inside the single sealing apparatus to form a combination cutting and sealing tool, the open ends of the bags are formed by use of the same combination cutting and sealing tool used to form the closed ends of adjacent bags.

19. The method according to claim 18, wherein the plurality of bags are generated one after the other in a forward movement direction, and when a closed end is formed, the sealing apparatus makes two complete transverse seals separated by a gap in the forward movement direction and the cutting apparatus makes a complete transverse cut in the gap.

20. The method according to claim 19, wherein the open ends and the closed ends are made alternately.

* * * * *